350-351 SR
PTU33 XR 4,228,754

United States Patent [19]
Shibata et al.
[11] 4,228,754
[45] Oct. 21, 1980

[54] OIL/WATER STORAGE TANK HAVING FLEXIBLE PARTITION MEMBRANE AND CHAMFERED INTERNAL EDGES AND CORNERS

[75] Inventors: Yutaka Shibata; Nobuyuki Tanaka; Ichiro Maruyama, all of Osaka, Japan

[73] Assignee: Sumitomo Electric Industries, Ltd., Osaka, Japan

[21] Appl. No.: 886,013

[22] Filed: Mar. 13, 1978

[51] Int. Cl.[3] ..... B63B 25/12

[52] U.S. Cl. ..... 114/74 R; 114/125; 220/85 B

[58] Field of Search ..... 114/74 R, 74 A, 121, 114/125, 74 T, 256, 257; 220/22, 22.1, 85 B; 222/214, 386.5; 405/205, 210

[56] References Cited

U.S. PATENT DOCUMENTS

| | | | |
|---|---|---|---|
| 2,347,379 | 4/1944 | Teeter | 220/85 B X |
| 2,879,785 | 3/1959 | Vesterdal et al. | 220/85 B X |
| 3,286,878 | 11/1966 | Schadt et al. | 220/85 B |
| 3,349,743 | 10/1967 | Field et al. | 114/125 |
| 3,766,875 | 10/1973 | Baki | 114/74 R X |
| 3,943,873 | 3/1976 | Hering et al. | 114/125 |
| 4,034,896 | 7/1977 | Wilson | 220/85 B X |

*Primary Examiner*—Trygve M. Blix
*Assistant Examiner*—Winston H. Douglas
*Attorney, Agent, or Firm*—Sughrue, Rothwell, Mion, Zinn & Macpeak

[57] ABSTRACT

A storage tank 1 is divided into oil and ballast water chambers 3, 4 by an elastic partition membrane 2. To prevent the membrane from blocking the oil and water intake/discharge ports 5, 6 during the final stages of loading or unloading, the internal edges and corners of the tank are chamfered by apertured partition plates, supported wire mesh screens or the like, and the intake/discharge ports communicate with the spaces defined behind such plates or screens.

4 Claims, 25 Drawing Figures

SECTIONAL SURFACE X

SECTIONAL SURFACE Y

OIL/WATER STORAGE TANK HAVING FLEXIBLE PARTITION MEMBRANE AND CHAMFERED INTERNAL EDGES AND CORNERS

BACKGROUND OF THE INVENTION

The present invention relates to a construction of a tank or tanker for the transportation or storage of a liquid such as crude oil, chemicals or the like, and more particularly to a ship hold construction wherein a partition membrane or a membrane receptacle is employed to prevent the mutual contamination of two kinds of oils loaded in the tanker or the mutual contamination of loaded oil and ballast water, especially for preventing the ballast water from being contaminated by the oil. The invention is applicable to not only a tanker but also to other installations such as a petroleum storage tank or the like in the sea or a storage or transportation tank of other liquids.

It is well known to separate ballast water and loaded oil in a compartment of a tanker by an elastic partition membrane or a membrane receptacle made of rubber coated cloth or the like in order to prevent the ballast water from being contaminated by the oil. Such partition membranes are disclosed in Japanese Patent Application No. 48-29184 and Japanese Utility Model Application No. 51-23392, 48-23187.

The conventional method of separating the ballast water and the oil disclosed in such applications will be briefly described. In FIGS. 1 and 2, a tank body or a ship held 1 is partitioned into an oil chamber 3 and a ballast water chamber 4 by securing a partition membrane 2 in a liquid tight manner along lines A-B, B-C, C-D and D-A of the tank 1. The chambers 3 and 4 are equipped with intake/exhaust ports 5 and 6 and gas exhaust pipes 7 and 8, respectively. Japanese Patent Application No. 51-20385 discloses a method wherein one surface of the membrane 2 is in contact with the ballast water while the other surface thereof is in contact with the oil during the charging and discharging of the water and the oil. FIGS. 2(*a*) to 2(*e*) show a process for the discharge of oil by a supply of ballast water, and FIGS. 2(*f*) to 2(*i*) show a process for the discharge of ballast water by supplying oil. In the case of a tanker, the process of FIGS. 2(*a*) to 2(*e*) is accomplished at the crude oil unloading base and the process of FIGS. 2(*f*) to 2(*i*) is done at the crude oil loading base.

A tank having such a partition membrane or membrane receptacles has a number of practical disadvantages, however, Firstly, in a stage of FIG. 2(*d*), for example, that is just before the oil is completely discharged, the partition membrane 2 is urged toward the upper surface of the tank 1 so that the intake/exhaust port 5 is clogged with or blocked by the membrane as shown in FIG. 3. As a result it is impossible to discharge the residual liquid from the tank. Further, if too much discharge force is applied the elastic material of the partition membrane, such as rubber coated cloth, is sucked into the intake/exhaust port 5 and the membrane may ultimately be broken. This is also true in the case of gas exhausting from the pipe 7. In order to eliminate this defect the intake/exhaust port could be moved to a more suitable position. Empirically, however, it is impossible to completely discharge the residual liquid from the tank 1 even when the position of the intake/exhaust port is appropriately selected. Alternatively, a plurality of intake/exhaust ports may be used. In this case, however, the space outside of the tank becomes unduly restricted whereby this arrangement of ports is impractical. Secondly, as shown in FIG. 4, unduly great tension is applied to portions 10 of the membrane 2 around the corners 9 or along the ridges of the tank 1 due to imperfect contact between the membrane 2 and the corners 9.

SUMMARY OF THE INVENTION

A primary object of the present invention is therefore to overcome the above mentioned defects by providing, in a tank for the transportation or storage of different liquids such as petroleum or chemicals, and having a membrane or membrane receptacle for preventing the different liquids from mixing with each other, plates in the tank for tightly contacting the membrane or membrane receptacle with the inner portions of the tank to prevent them from clogging the exhaust port or the gas exhausting pipe when one of liquids or gas is exhausted from the tank.

DETAILED DESCRIPTION OF THE PREFERRED EMBODIMENTS

Figure 5A:
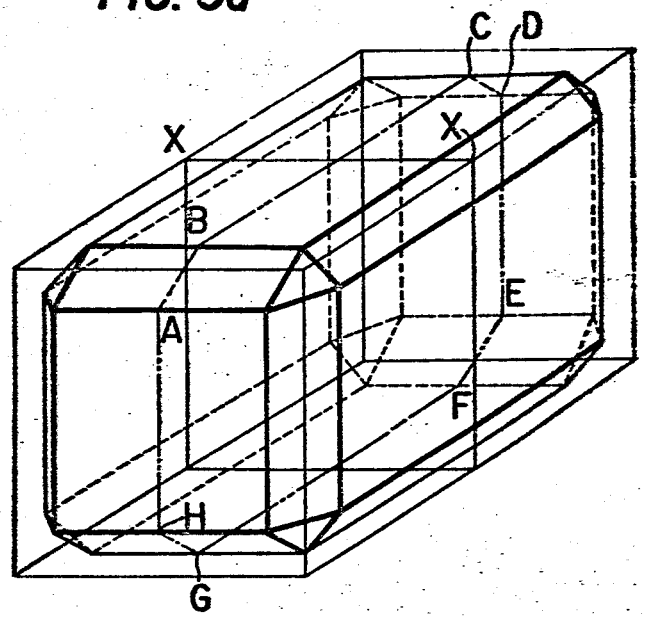
Figure 5B:
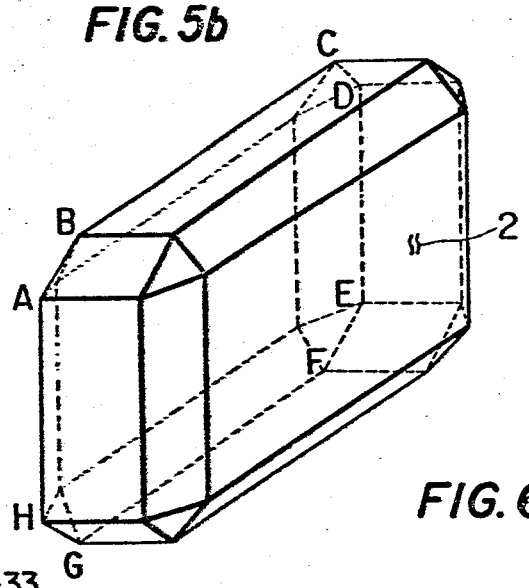

The present invention will now be described with reference to FIGS. 5 to 19. The embodiment of FIG. 5(a) shows a rectangular tank according to the invention having chamfered edges and corners. FIG. 5(b) shows the configuration of a partition membrane 2 in the tank of FIG. 5(a) when one of the liquids is fully loaded in one of the halves of the tank. As may easily be seen, the membrane conforms to the internal configuration of the tank. The partition membrane is secured to the tank along the central plane lines A-B-C-D-E-F-G-H-A.

Figure 6:
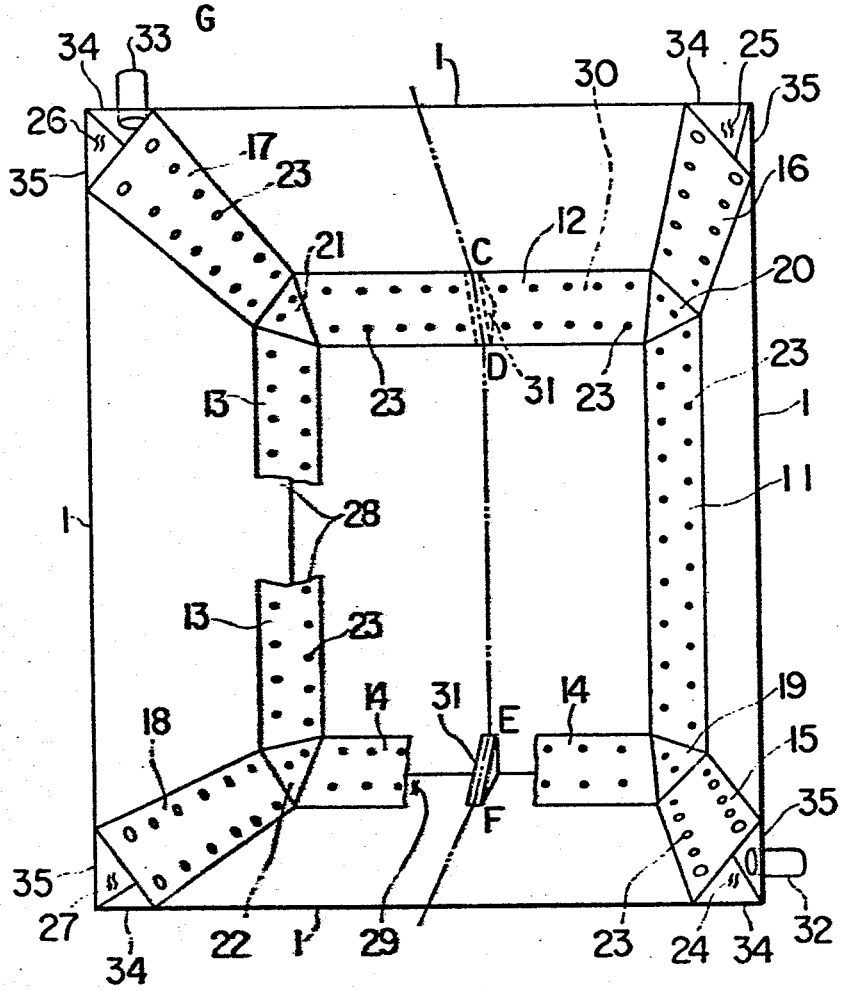
FIG. 6 is a cross sectional perspective view taken along the line X—X in FIG. 5(*a*), FIG. 7(*a*) shows the effect of the invention wherein the membrane is substantially reversed in the last stage of the ballast water exhaust, FIG. 7(*b*) is a cross section taken along the line X—X in FIG. 7(*a*), FIG. 7(*c*) is a cross section taken along the line Y—Y in FIG. 7(*a*)

FIG. 6 is a cross sectional perspective view of the tank or tanker along the line X—X in FIG. 5(a), with the partition membrane removed for simplification. Reference number 1 designates a tank body and reference numerals 11 to 22 designate membrane suction preventing plates at the ridge and corner portions of the tank body to thereby define spaces 24 to 30 therebetween. Each of the plates 11 to 18 is formed with a plurality of through-holes 23. Partitioning plates 31 serve to divide the spaces 29 and 30 defined by the plates 12 and 14 into one for ballast water and the other for oil, respectively, to thereby separate the interior of the tank 1 into two spaces with the intermediate membrane. Reference numeral 32 designates an intake/exhaust port for ballast water and 33 an intake exhaust port for oil. The port 32 is provided in a wall 35 of the tank defining the space 24; the port 33 is provided in a tank wall 34 defining the space 26. A gas exhaust pipe(s) (not shown) is also provided in the tank wall 34. In this construction the exact positions of the intake/exhaust ports 32 and 33 and the gas exhaust pipe are determined by external considerations such as pump arrangements, pipe line systems, balance of adjacent tanks and the like. The spacings 24 to 30 defined by the preventing plates 11 to 22 at the ridges and corners of the tank provide liquid passages, and the plates 11 to 22 per se serve to chamfer the internal tank configuration.

Figure 1A:
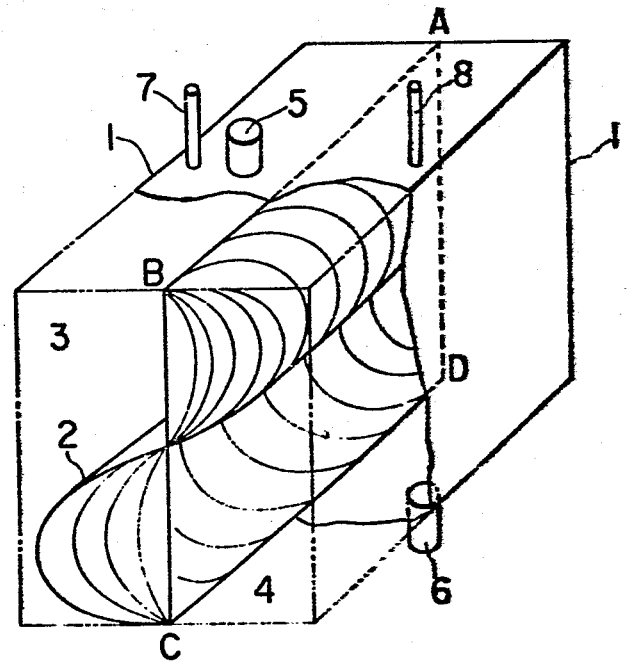
FIG. 1a PRIOR ART
FIG. 1(*a*) is a partially cutaway perspective view of a tank or ship hold having a partition membrane according to the prior art, FIG. 1(*b*) is a cross section of the tank of FIG. 1(*a*), FIGS. 2(*a*) to 2(*i*) illustrate the intake and discharge between the oil and the ballast water in the tank of FIGS. 1 and 2.
Figure 1B:
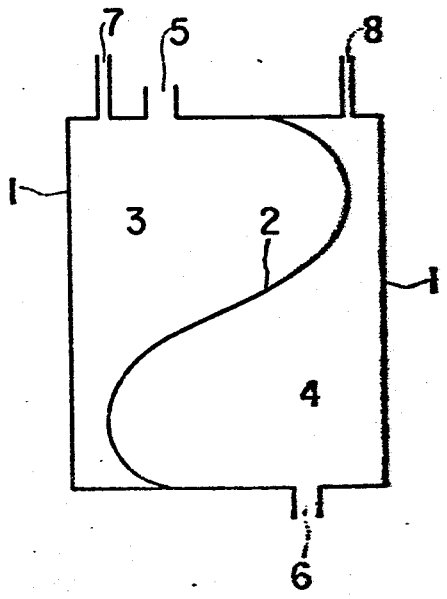
FIG. 1b PRIOR ART
Figure 2:
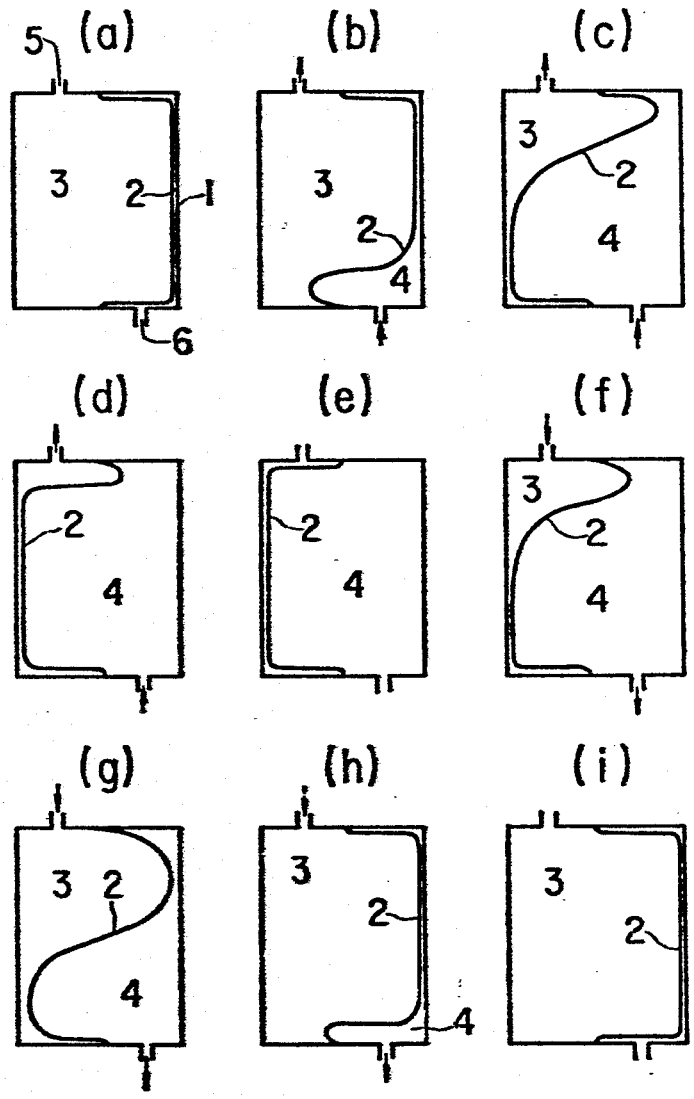
FIG. 2 PRIOR ART
Figure 3:
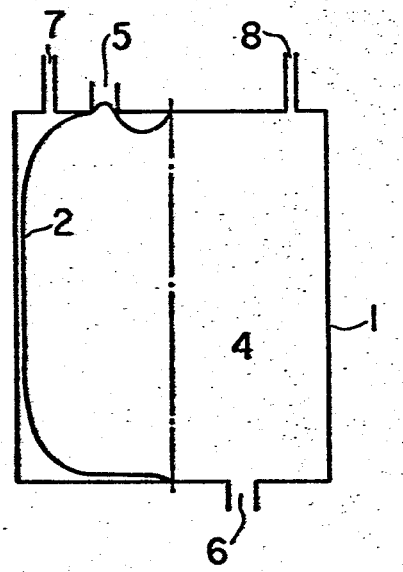
FIG. 3 PRIOR ART
FIG. 3 shows the membrane of FIG. 1(*a*) clogging the intake/exhaust port.
Figure 4:
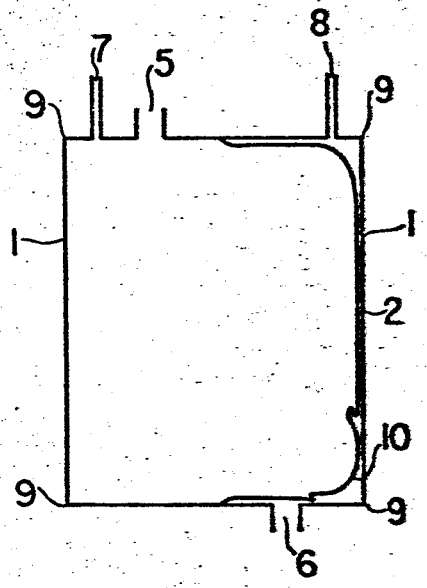
FIG. 4 PRIOR ART
FIG. 4 shows the membrane of FIG. 1(*a*) in imperfect contact with the corner walls of the tank, FIG. 5(*a*) shows the internal configuration of a tank having a chamfered rectangular cross section according to the present invention, FIG. 5(*b*) shows the configuration of the membrane employed in the tank of FIG. 5(*a*)
Figure 7A:
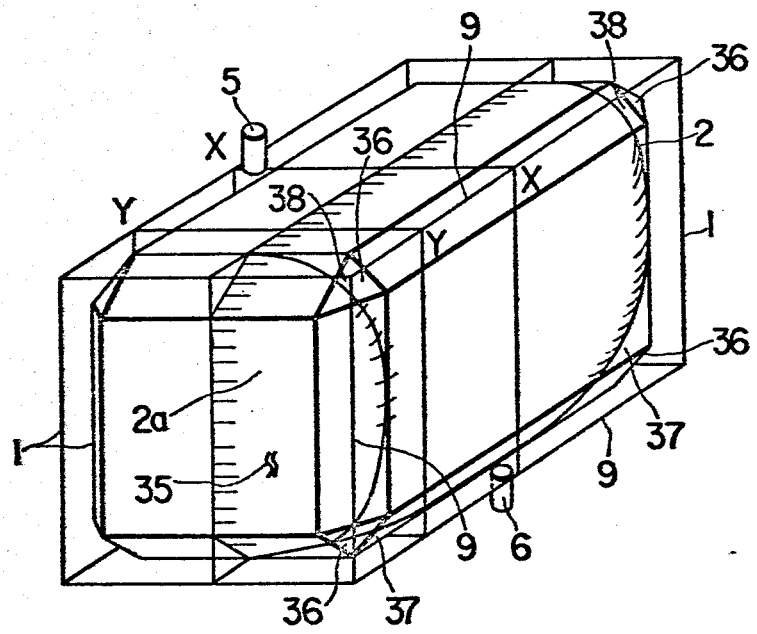
Figure 7B:
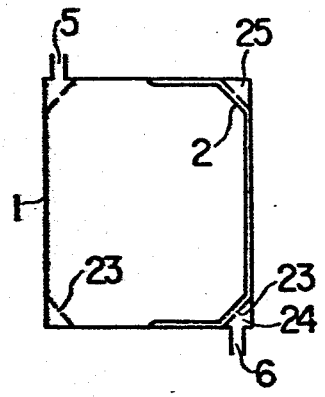
Figure 7C:
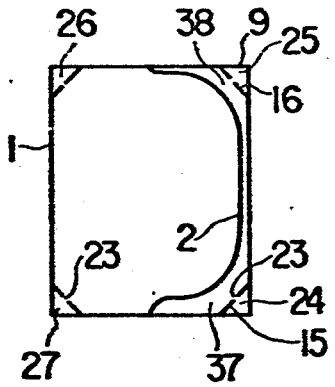

FIGS. 7(a) to 7(c) show the effect of the membrane suction preventing plates of the present invention, FIG. 7(a) showing the partition membrane 2 in the tank 1 at the final stage of the ballast water discharging. In this case the tank 1 is provided with intake/exhaust ports 5 and 6 around the center portion thereof. FIG. 7(b) and FIG. 7(c) are sectional views taken along lines X—X and Y—Y in FIG. 7(a), respectively. At this stage the partition membrane 2 at the plane including the line X—X is completely urged against the tank walls as seen in FIG. 7(b) while the membrance at the plane including the line Y—Y is only partially urged against the walls due to the restrictive force provided by side portion 2a of the membrane, whereby a considerable amount of ballast water remains within spaces 37 and 38 as seen in FIG. 7(c). It is difficult to completely discharge the ballast water in the spaces 37 and 38 without the preventing plates 15 and 16 since the intake/exhaust port 6 disposed at the plane including the line X—X is clogged by the action of the partition membrane as shown in FIG. 3. According to the present invention, however, it is easy to completely exhaust such residual ballast water through the holes 23 and the spaces 24 and 25, provided that any through-holes 23 in the plates 15 and 16 remain unclogged by the membrane 2. Further, the spaces formed between the preventing plates 11 to 22 and the walls of the tank 1 are useful for the installation of bell mouth pipes, eductors and the like.

If the intake/exhaust port 6 is positioned near a corner portion 36 of the tank the amount of liquid capable of being discharged may be increased in comparison with a position at the central portion of the tank as shown in FIG. 7(a), but it is still impossible to completely discharge the tank.

Figure 8:
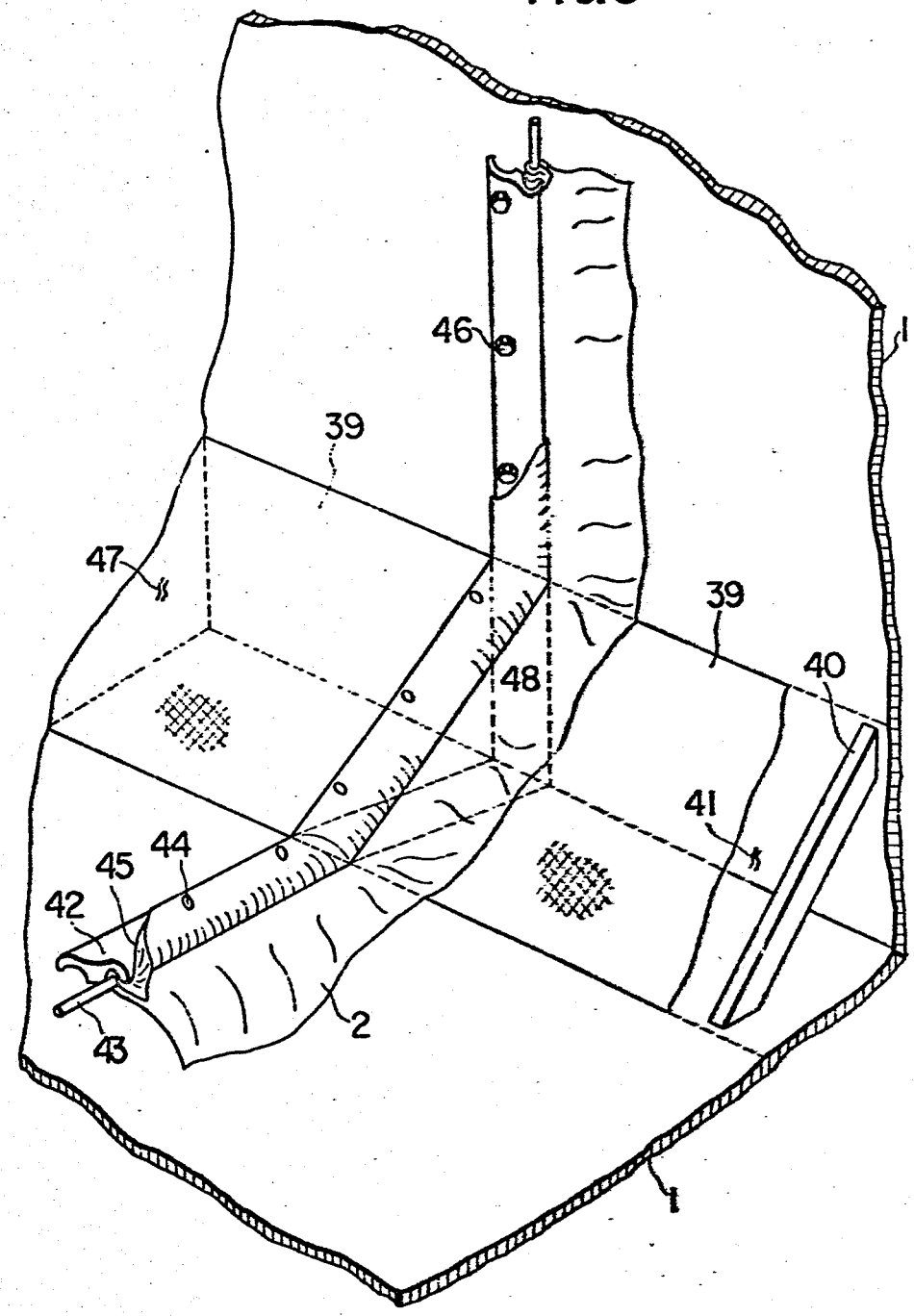
FIG. 8 shows a partial view of the tank of the invention in which a mesh is employed as the preventing plate, FIGS. 9(*a*) and 9(*b*) show another embodiment of the invention wherein the partition membrane is obliquely secured to a rectangular tank, FIG. 9(*a*) being a transparent view of the tank and FIG. 9(*b*) being a view of the configuration of the membrane.

In the above embodiment the plates having a plurality of holes are used as the preventing plates. Each plate may also be constituted by a plurality of solid, closely spaced plates having no holes therein. Alternatively, each plate may be in the form of a metal wire mesh, as shown in the partially enlarged view of FIG. 8. Thus, reference numeral 39 designates a mesh preventing plate and 40 is a supporting member disposed at intervals along the space 41 to reinforce the mesh. FIG. 8 also shows a method for securing the partition membrane 2 to the tank 1, which is disclosed in Japanese Patent Application Nos. 51-20386 and 20391. Reference numeral 42 designates a clamping bar, 43 a rod, 44 drive screws for securing the partition membrane 2 at its folded portions 45, and 46 bolts or the like for securing the clamping bar and the partition membrane firmly to the walls of the tank. Space 47 is completely separated from space 41 by a solid partition plate 48 shown by a dotted line.

Figure 9A:
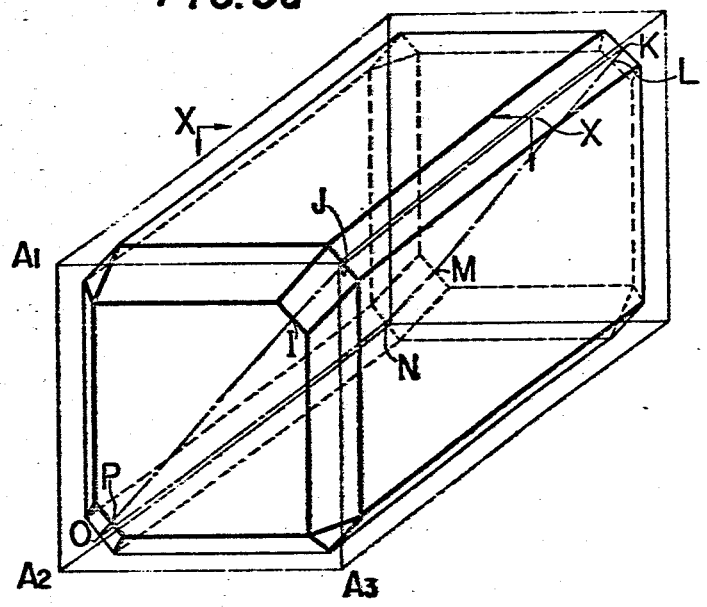
Figure 9B:
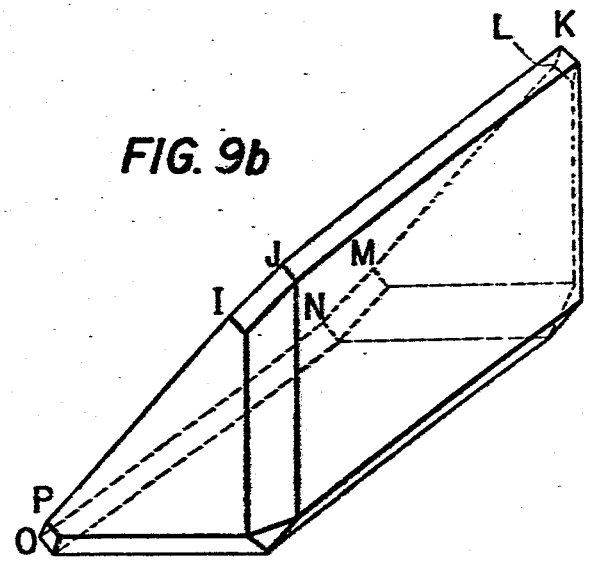
Figure 10:
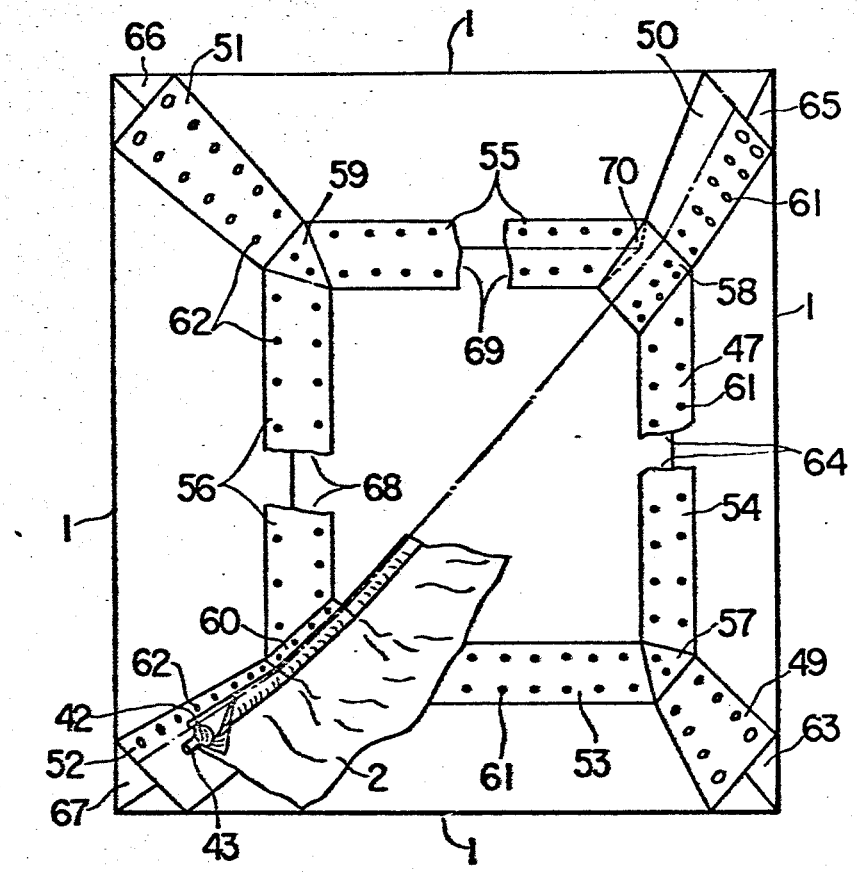
FIG. 10 is a cross sectional view taken through the center plane of the tank of FIG. 9(*a*), FIGS. 11(*a*) and 11(*b*) show still another embodiment of the invention, FIG. 11(*a*) being a transparent view of the tank and FIG. 11(*b*) being a view of the configuration of the membrane.

FIGS. 9(a), 9(b) and 10 show another embodiment wherein the partition membrane is obliquely disposed in a diagonal plane of the tank. FIG. 9(a) shows the internal configuration of the tank and FIG. 9(b) shows the configuration of the membrane. In FIG. 9(a), the partition membrane is secured diagonally along lines I-J-K-L-M-N-O-P-I. Referring to the cross sectional view of FIG. 10, preventing plates 49 to 60 are provided with a plurality of holes 61 and 62 and define spaces 63, 64 and 65 for the ballast water and spaces 66, 67, 68 and 69 for the oil. The preventing plates 49 to 60 also serve to stiffen and structurally reinforce the tank 1. Partition plates 70 complete the separation. The partition membrane 2 is secured to the preventing plates by clamping bars 42, rods 43 and the like. In order to secure the membrane 2 diagonally or obliquely, the tank 1 should preferably have a substantially square cross section. That is, in FIG. 9(a) the length of $A_1A_2$ should be equal to that of $A_2A_3$.

Figure 11A:
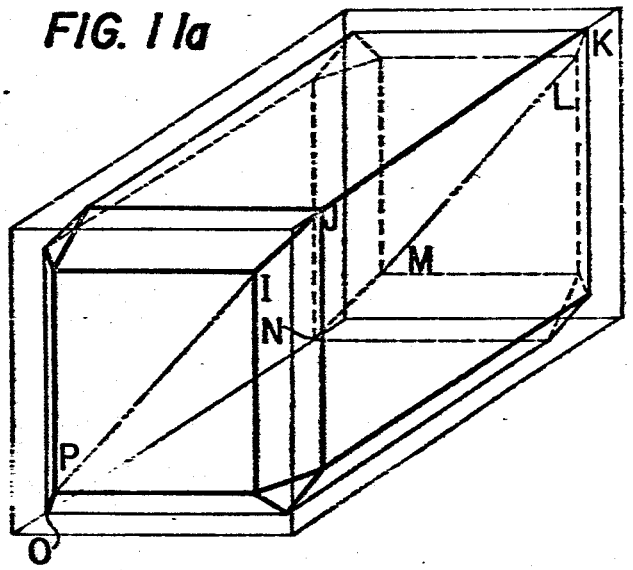
Figure 11B:
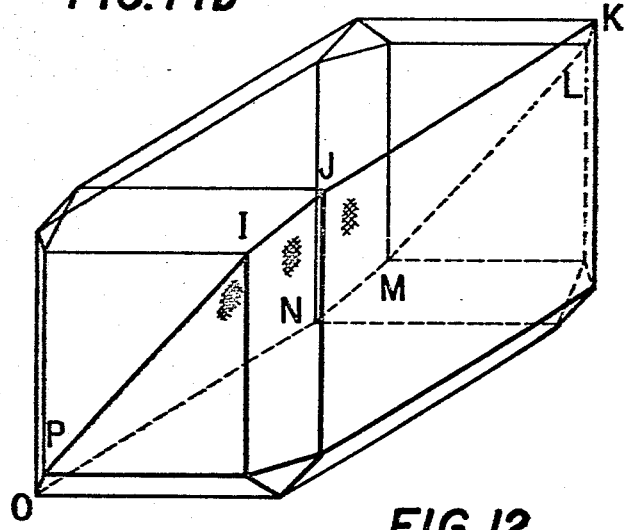
Figure 12:
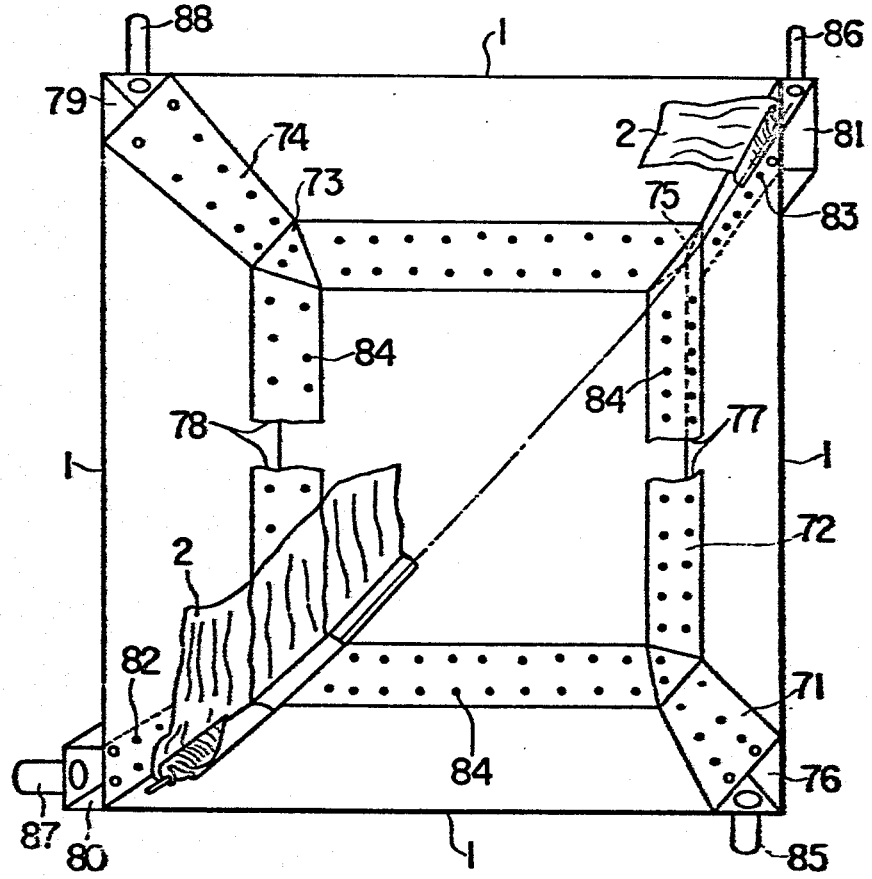
FIG. 12 is a cross sectional view taken through the center plane of the tank of FIG. 11(*a*), FIGS. 13(*a*) and 13(*b*) show the effect of the preventing plates of the invention wherein the membrane is obliquely secured, FIG. 13(*a*) being a transparent view of the tank and FIG. 13(b) being a cross section taken through the center plane of the tank of FIG. 13(a), FIGS. 14 and 15 show a further embodiment of the invention, wherein bell mouth pipes and other pipes are arranged in the spaces between the walls of the tank and the preventing plates.

FIGS. 11 and 12 show another embodiment of the invention wherein the preventing plates 50 and 52 in FIG. 10 are omitted. FIG. 11(a) shows the internal configuration of the tank while FIG. 11(b) shows the configuration of the partition membrane which is secured along the diagonal plane I-J-K-L-M-N-O-P-I. Reference numerals 71, 72, 73 and 74 in FIG. 12 designate the preventing plates. Partition plates 75 separate the spaces 76, 77 and 78, 79 into one for ballast water and the other for oil. Further spaces 80 and 81 are formed outside the tank, with the space 81 communicating with spaces 76 and 77 while the space 80 communicates with space 78, 79. The surfaces of the spaces 80 and 81 toward the walls of the tank are provided with a plurality of holes 82 and 83. The oil enters through the space 80 and the ballast water through the space 81. The other preventing plates 71 to 74 are provided with a plurality of holes 84. An intake/exhaust port 85 for ballast water is positioned at an appropriate position for space 76 and a gas exhaust port 86 is positioned at an appropriate position of space 81. An oil intake/exhaust port 87 is provided at space 80 while another gas exhaust port 88 is provided at space 79.

Figure 13A:
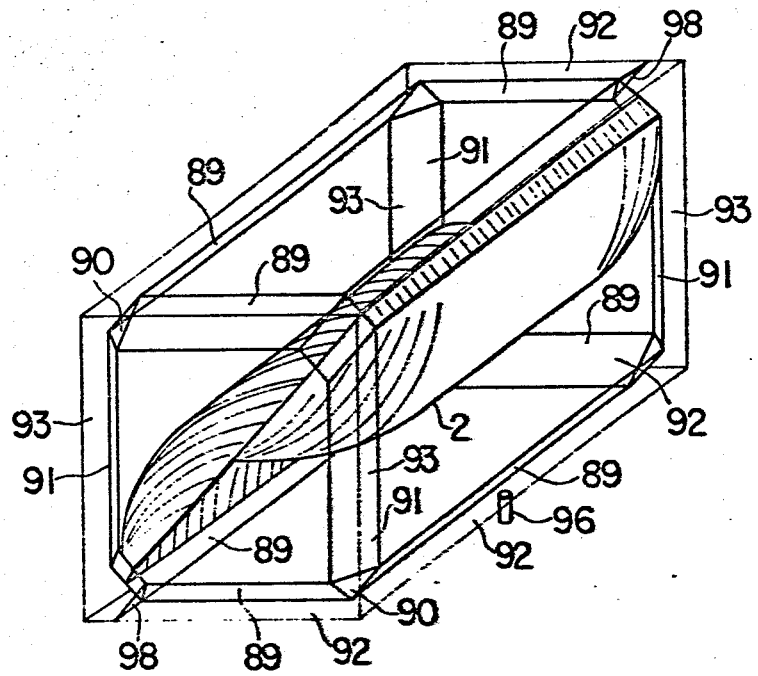
Figure 13B:
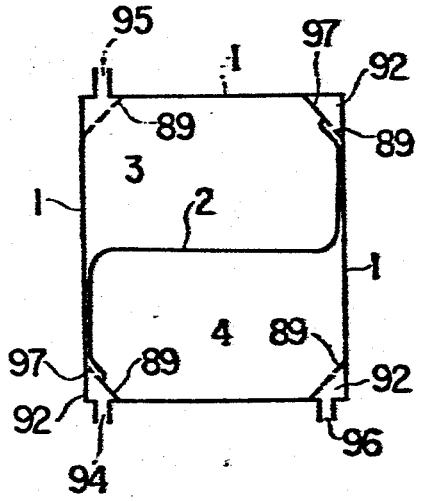

FIG. 13, which corresponds to the embodiment of FIG. 10, illustrates the effect of the invention in a tanker wherein the partition membrane is obliquely secured. FIG. 13(*a*) is a transparent view and FIG. 13(*b*) is a central cross section of FIG. 13(*a*). In the case of such oblique securing of the membrane vertical preventing plates such as 54 and 56 in FIG. 10 or 84 in FIG. 12 are very important. In FIG. 13 reference numerals 80, 90 and 91 designate preventing plates, 92 spaces defined by the plates 89 and 90, 93 spaces defined by the vertical plates 91, 94 and 95 intake/exhaust ports oil, and 96 an intake/exhaust port for ballast water.

The spaces 92 and 93 are separated into one for ballast water and the other for oil by partition plates 98. If the vertical plates 91 are omitted it is impossible to exhaust oil from the intake/exhaust port 94 due to the blocking action of the partition membrane. In this case it is difficult to discharge the oil only through the intake/exhaust port 95 and the pump system therefore becomes considerably complicated. If the vertical preventing plates 91 and the spaces defined thereby are provided, however, the oil can be discharged through both of the intake/exhaust ports 94 and 95 since the spaces 92 communicate with the spaces 93. Further, it is possible to provide bell mouth or the like pipes in the spaces 92 and 93 as mentioned hereinafter.

Figure 14:
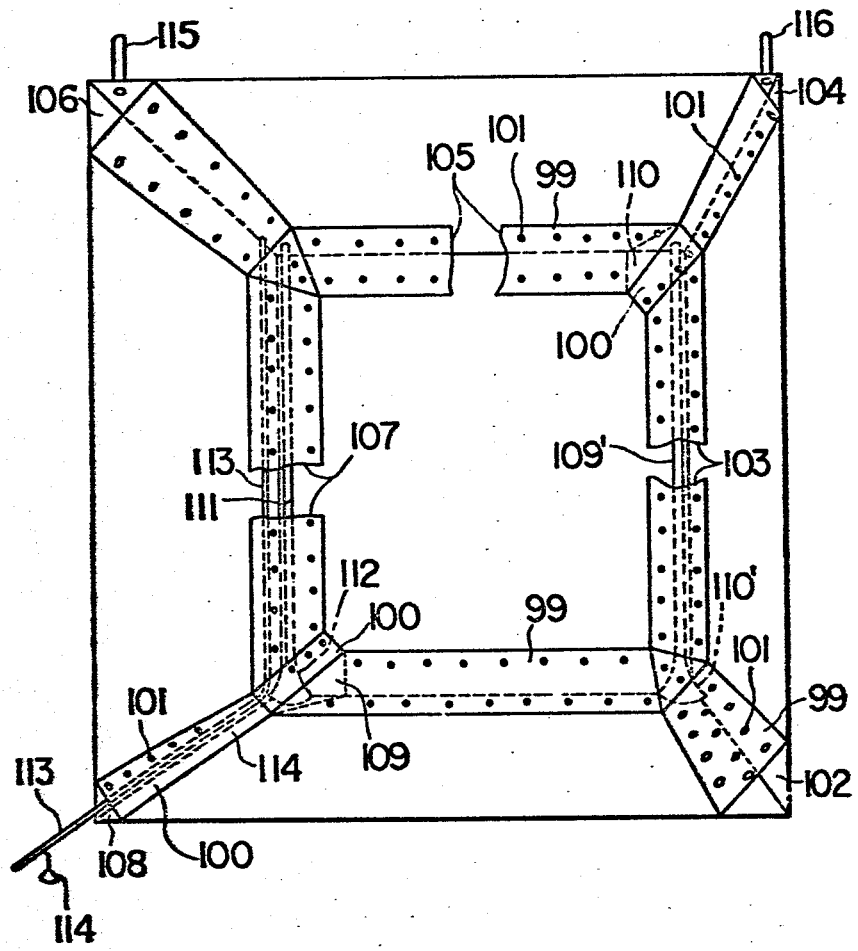
Figure 15:
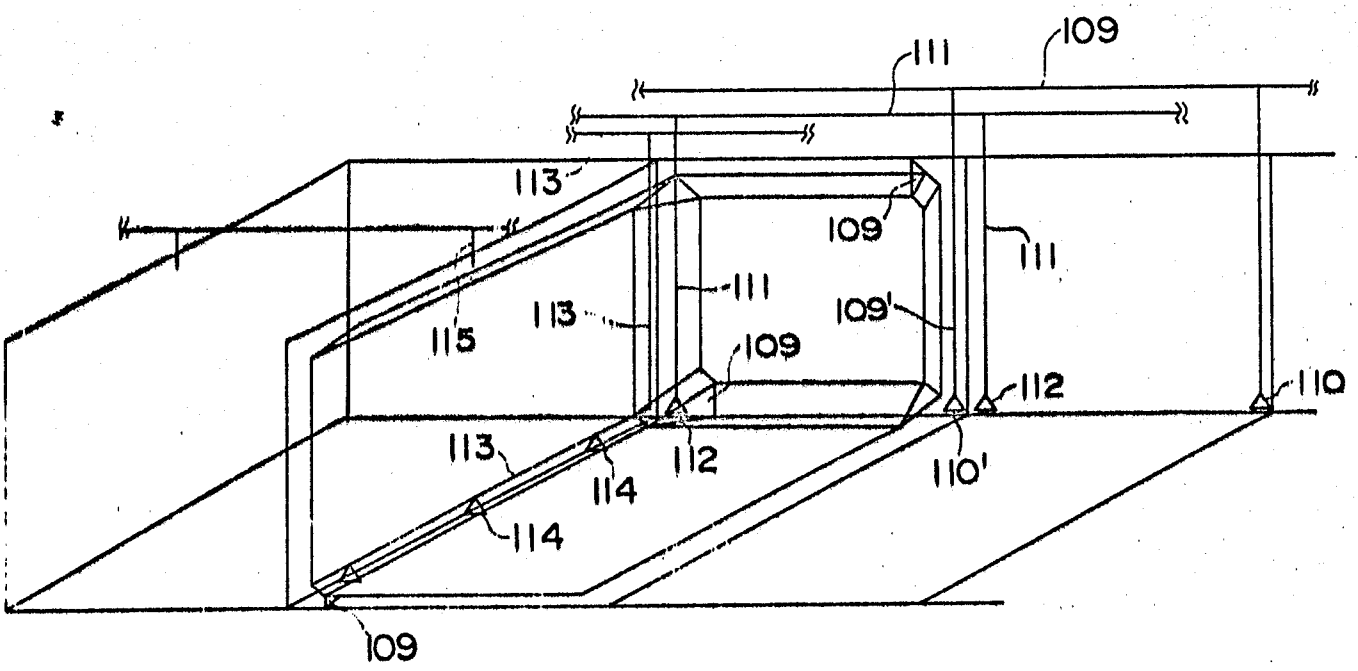

FIGS. 14 and 15 show a further embodiment of the invention wherein the partition membrane is obliquely secured as in the embodiment of FIGS. 10 and 12, and bell mouth pipes 114 and the like are provided in the spaces between the tank body 1 and the preventing plates. FIG. 15 shows a pipe system for a plurality of the tanks shown in FIG. 14, in the case of a tanker having a large oil carrying capacity. In FIGS. 14 and 15, reference numerals 99 and 100 designate preventing plates having a plurality of holes 101. The position of the holes 101 in the preventing plates 100 is determined by the position and configuration of the membrane securing member, such as the clamping bar shown in FIG. 18. The preventing plates 99 and 100 define spaces 102 to 108 for the oil and water, with separation being provided by the partition plates 109 and 110. In suitable positions in these spaces are provided pipes 109' and bell mouth pipes 110' for the ballast water, and pipes 111, bell mouth pipes 112, stripping pipes 113 and communicating bell mouth pipes 114 for the oil. The bell mouth pipes 114 may be replaced by steam eductors, which may also be used for the ballast water in the space 102. The spaces 102 to 108 are used for the pipes and bell mouth pipes to save space.

Heretofore, the configuration of the preventing plates has been flat or planar. However, preventing plates having curved surfaces as shown in FIG. 16 may also be used with the same effect as described above.

Figure 16A:
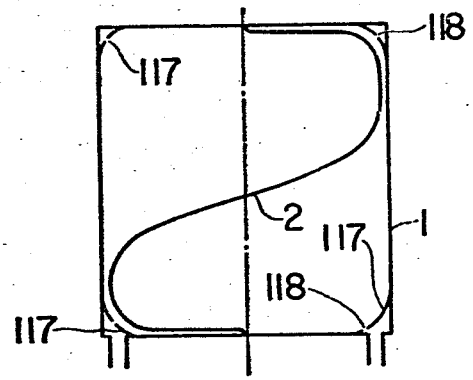
FIGS. 16(a) and 16(b) show a further embodiment of the invention wherein curved preventing plates are employed.
Figure 16B:
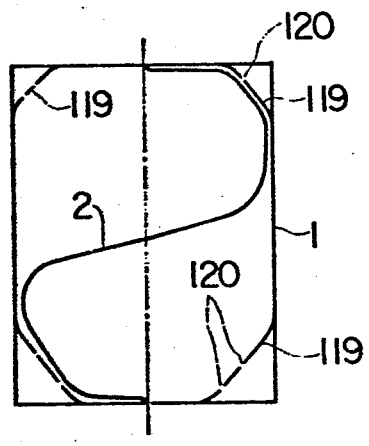
Figure 17:
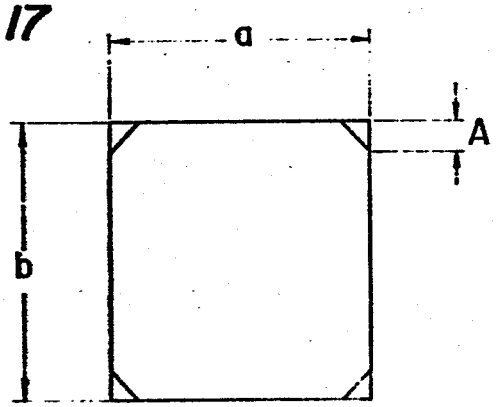
FIG. 17 is a schematic view of the tank of the invention illustrating the dimensions thereof.

In FIG. 16(*a*), reference numeral 117 designates preventing plates having curved surfaces and a plurality of holes 118. In FIG. 16(*b*) preventing plates 119 having a plurality of holes 120 are formed with both curved and planar surfaces. The dimensions of the preventing plates may be variable as seen by comparing FIGS. 16(*a*) and (*b*).

In FIGS. 5 to 15 the dimensions of the preventing plates are somewhat exaggerated for purposes of illustration. Actually, referring to FIG. 17, the ratio of the side or top dimension A of the preventing plate to the lateral width a and vertical height b of the tank should be in the range of 1/50 to 1/3.

Figure 18:
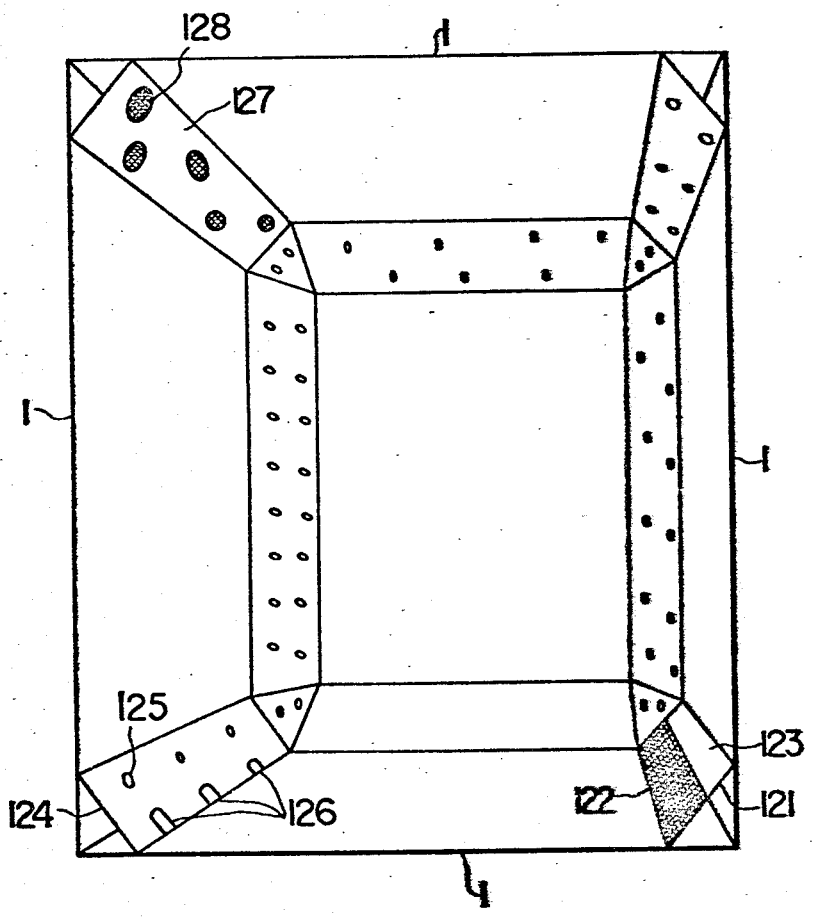
FIG. 18 shows the several kinds of preventing plates which may be used in a tank according to the invention.

FIG. 18 shows a mixed embodiment of the invention wherein a preventing plate 121 consists of a mesh 122 and a solid plate 123, a preventing plate 124 has a plurality of through-holes 125 and slots 126 open to the tank body 1, and a preventing plate 127 has holes 128 covered with mesh on the back surface of the plate.

The preventing plates also serve to greatly enhance the structural reinforcement and rigidity of the tank body 1.

Figure 19:
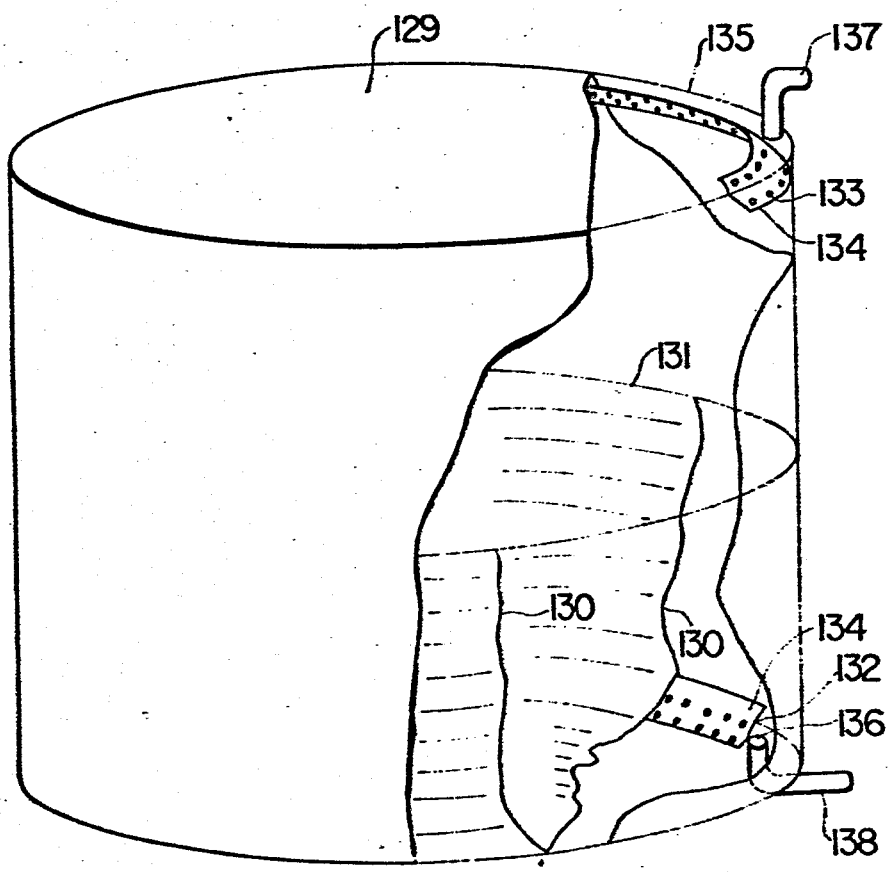
FIG. 19 shows another embodiment of the invention wherein the shape of the tank is cylindrical.

In the above mentioned embodiments, the configuration of the tank is that of a substantially rectangular parallelopiped. However, the technique and spirit of the invention can also be applied to a cylinder shaped tank as shown in FIG. 19 wherein reference numeral 129 designates a cylindrical tank, 130 a partition membrane secured along a horizontal mid-section line 131 of the tank, 132 and 133 preventing plates having a plurality of holes 134 and defining spaces 135 and 136, and 137 and 138 intake/exhaust ports communicating with the spaces 135, 136.

What is claimed is:

1. In a tank for the storage and/or transportation of two different fluids, such as crude oil and ballast water, having walls and including a flexible partition membrane disposed within the tank for separating it into two different, variable volume compartments for the respective fluids to thereby prevent their mutual mixing and contamination, and ports provided in the walls of the tank communicating with each compartment for the intake/discharge of said fluids the improvement characterized by:

perforated plate means disposed on the interior of said tank to chamfer the edges and corners of the walls of the tank and to shield said ports from said membrane, thereby preventing said membrane from blocking any of said ports during the final stages of a fluid supply or discharge operation, said ports for the intake and/or discharge of the fluids communicating with respective compartments through spaces defined between said perforated plate means and the walls of the tank.

2. A tank as defined in claim 1, wherein each of said perforated plate means has a plurality of through-holes therein.

3. A tank as defined in claim 1, wherein each of said perforated plate means comprises a wire mesh.

4. A tank as defined in claim 1, wherein the perforated plate means are rigidly secured to the edges and corners of the tank, to thereby stiffen and structurally reinforce said tank.

* * * * *